US010033079B2

(12) United States Patent
Nakaike et al.

(10) Patent No.: US 10,033,079 B2
(45) Date of Patent: Jul. 24, 2018

(54) NON-RECIPROCAL CIRCUIT ELEMENT

(71) Applicant: Murata Manufacturing Co., Ltd., Kyoto (JP)

(72) Inventors: Yuki Nakaike, Kyoto (JP); Kenji Matsuda, Kyoto (JP); Yuko Fujita, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 97 days.

(21) Appl. No.: 15/178,063

(22) Filed: Jun. 9, 2016

(65) Prior Publication Data

US 2016/0294032 A1 Oct. 6, 2016

Related U.S. Application Data

(63) Continuation of application No. PCT/JP2014/081759, filed on Dec. 1, 2014.

(30) Foreign Application Priority Data

Dec. 18, 2013 (JP) ..... 2013-260916

(51) Int. Cl.

| | |
|---|---|
| ***H01P 1/383*** | (2006.01) |
| ***H01P 1/36*** | (2006.01) |
| ***H01P 1/365*** | (2006.01) |
| ***H01F 1/34*** | (2006.01) |

(52) U.S. Cl.

CPC ..... *H01P 1/383* (2013.01); *H01F 1/346* (2013.01); *H01P 1/36* (2013.01); *H01P 1/365* (2013.01)

(58) Field of Classification Search

CPC ..... H01P 1/36; H01P 1/38; H01P 1/383
USPC ..... 333/1.1, 24.2
See application file for complete search history.

(56) References Cited

U.S. PATENT DOCUMENTS

| | | | |
|---|---|---|---|
| 2005/0128023 | A1 | 6/2005 | Takahashi |
| 2009/0321677 | A1 | 12/2009 | Lebourgeois |
| 2012/0056690 | A1 | 3/2012 | Hasegawa |

FOREIGN PATENT DOCUMENTS

| | | | |
|---|---|---|---|
| JP | 05251788 | A | 9/1993 |
| JP | 2003046307 | A | 2/2003 |
| JP | 2005184088 | A | 7/2005 |
| JP | 2010045566 | A | 2/2010 |
| JP | 2012054848 | A | 3/2012 |
| JP | 2013236142 | A | 11/2013 |
| WO | 2007046229 | A1 | 4/2007 |

(Continued)

OTHER PUBLICATIONS

International Search Report issued in application No. PCT/JP2014/081759 dated Mar. 3, 2015.

(Continued)

*Primary Examiner* — Stephen E Jones
(74) *Attorney, Agent, or Firm* — Pearne & Gordon LLP

(57) ABSTRACT

In a non-reciprocal circuit element, electric power handling capability is improved, and leakage power between adjacent channels is reduced. In addition, balance is taken between reduction of noise between adjacent ports and an increase in insertion loss. A non-reciprocal circuit element includes a YIG ferrite (10) and a plurality of conductors (15) disposed on the YIG ferrite (10) and intersecting each other in an insulated state. A part of Y of the YIG ferrite (10) is substituted with at least any one element of Ho, Dy, and Gd, or a part of Fe of the YIG ferrite (10) is substituted with Co.

20 Claims, 6 Drawing Sheets

(56) References Cited

FOREIGN PATENT DOCUMENTS

| | | | |
|---|---|---|---|
| WO | 2011077803 | A1 | 6/2011 |
| WO | 2013168771 | A1 | 11/2013 |

OTHER PUBLICATIONS

Written Opinion issued in application No. PCT/JP2014/081759 dated Mar. 3, 2015.

NON-RECIPROCAL CIRCUIT ELEMENT

BACKGROUND OF THE DISCLOSURE

Field of the Disclosure

The present disclosure relates to a non-reciprocal circuit element, and particularly relates to a non-reciprocal circuit element such as an isolator or a circulator used in the microwave bands or other bands.

Description of the Related Art

In general, a non-reciprocal circuit element such as an isolator or a circulator has characteristics of transmitting signals only in a specific direction and not transmitting signals in the opposite direction, and is mounted in a transmitting circuit unit of a mobile communication apparatus such as a cellular phone.

Patent Document 1 describes a two-terminal-pair isolator in which first and second center conductors are disposed near the center of a ferrite, to which a static magnetic field is applied, so as to intersect each other in an electrically insulated state, ends of the first and second center conductors are first and second input/output terminals, respectively, the other ends of the first and second center conductors are connected to ground, a first matching capacitor is connected between the first input/output terminal and the ground, a second matching capacitor is connected between the second input/output terminal and the ground, a resistance element is connected to the first and second input/output terminals, and the intersection angle between the central axis of the first center conductor and the central axis of the second center conductor is 40° to 80°.

Patent Document 2 describes a two-port-type isolator in which a first center electrode and a second center electrode are disposed on a ferrite, to which a DC magnetic field is applied, so as to intersect each other in an insulated state, one end of the first center electrode is connected to an input port, the other end of the first center electrode and one end of the second center electrode are connected to an output port, the other end of the second center electrode is connected to a ground port, and further a matching capacitor and a resistance element are connected in parallel between the input port and the output port.

Patent Document 3 describes a magnetic resonance (ferrite absorption) isolator that includes a ferrite, a junction conductor disposed on the ferrite and having a first port, a second port, and a third port, and a permanent magnet for applying a DC magnetic field to the ferrite, and in which a main line disposed between the first port and the second port of the junction conductor does not resonate, an end portion of a sub-line branching from the main line is the third port, a reactance element is connected to the third port, the reactance element is connected to ground, and an impedance matching circuit is connected to the first port and the second port.

Non Patent Document 1 describes a circulator in which center electrodes are overlaid on a ferrite, to which a DC magnetic field is applied, so as to intersect each other at an angle of 120° in an electrically insulated state.

Non Patent Document 2 indicates that it is possible to improve electric power resistance by substituting a garnet ferrite (YIG) with Co, Ho, and Dy.

Meanwhile, in recent years, a non-reciprocal circuit element has been reduced in size, and the lengthwise and crosswise dimensions are 2.0 mm and the thickness dimension is 0.60 mm or less so that the size of the non-reciprocal circuit element is very small. Thus, when such a non-reciprocal circuit element is used in a wireless apparatus, there have been apparent needs to improve the electric power handling capability and to reduce the leakage power between the adjacent channels. In addition, in a non-reciprocal circuit element, it is desirable to reduce the noise between the adjacent ports. However, when an attempt is made to reduce the noise, a problem of an increase in the insertion loss arises, and thus it is also necessary to take a balance therebetween.

Patent Document 1: Japanese Unexamined Patent Application Publication No. 2003-046307

Patent Document 2: International Publication No. 2007/046229

Patent Document 3: International Publication No. 2011/077803

Non Patent Document 1: Systematization of Ferrite Technology, Systematization Investigation of Technology of National Museum of Nature and Science, Vol. 13, 2009, p 171

Non Patent Document 2: Microwave Ferrite and its Applied Technology, p 161, written by Tadashi Hashimoto

BRIEF SUMMARY OF THE DISCLOSURE

An object of the present disclosure is to provide a non-reciprocal circuit element that is able to improve the electric power handling capability and reduce the leakage power between the adjacent channels. In addition, another object of the present disclosure is to provide a non-reciprocal circuit element in which a balance is taken between the reduction of the noise between the adjacent ports and an increase in the insertion loss.

A non-reciprocal circuit element according to a first aspect of the present disclosure includes:

a YIG ferrite; and a plurality of conductors disposed on the YIG ferrite and intersecting each other in an insulated state, wherein a part of Y of the YIG ferrite is substituted with at least any one element of Ho, Dy, and Gd or a part of Fe of the YIG ferrite is substituted with Co.

A non-reciprocal circuit element according to a second aspect of the present disclosure includes:

a YIG ferrite; and a plurality of conductors disposed on the YIG ferrite and intersecting each other in an insulated state, wherein 0.0025 mol to 0.0200 mol of Fe of the YIG ferrite is substituted with Co.

A non-reciprocal circuit element according to a third aspect of the present disclosure includes:

a YIG ferrite; and a plurality of conductors disposed on the YIG ferrite and intersecting each other in an insulated state, wherein 0.1 mol to 0.4 mol of Y of the YIG ferrite is substituted with Dy.

A non-reciprocal circuit element according to a fourth aspect of the present disclosure includes:

a YIG ferrite; and a plurality of conductors disposed on the YIG ferrite and intersecting each other in an insulated state, wherein 0.02 mol to 0.05 mol of Y of the YIG ferrite is substituted with Ho.

According to the non-reciprocal circuit element of the first aspect, by substituting a part of Y of a garnet YIG ferrite with at least any one element of Ho, Dy, and Gd or substituting a part of Fe of the garnet YIG ferrite with Co, the electric power resistance of a non-reciprocal circuit element (an isolator, a circulator) is improved, and the leakage power between the adjacent channels is reduced. In addition, according to the non-reciprocal circuit elements of the second, third, and fourth aspects, it is possible to reduce the noise between the adjacent ports and suppress an increase in the insertion loss as much as possible.

DETAILED DESCRIPTION OF THE DISCLOSURE

Figure 1:
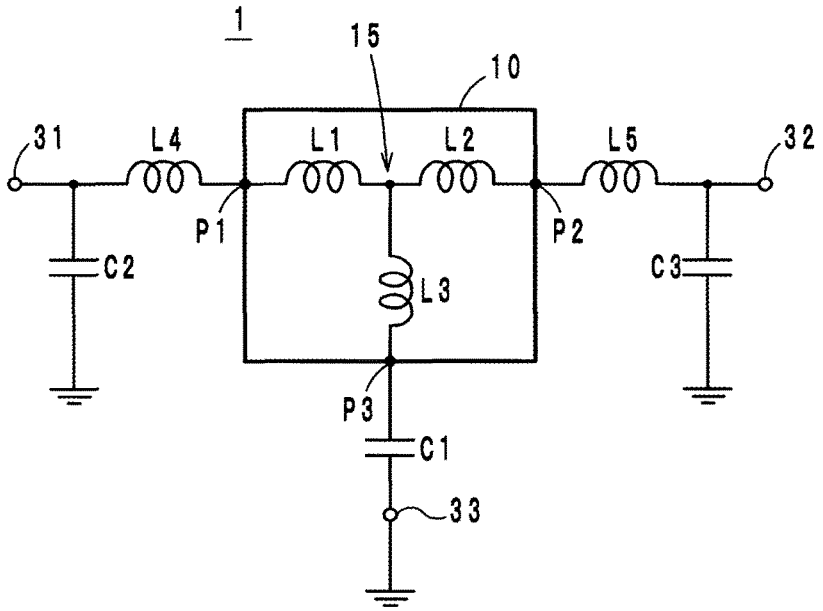
FIG. 1 is an equivalent circuit diagram showing a non-reciprocal circuit element (isolator) according to a first embodiment.

Hereinafter, embodiments of the non-reciprocal circuit element according to the present disclosure will be described with reference to the accompanying drawings. In the respective drawings, the common elements and portions are designated by like reference numerals, and the overlapped description is omitted.

(First Embodiment, See FIGS. 1 to 5)

As shown in FIG. 1, a non-reciprocal circuit element according to a first embodiment is a two-port-type ferrite absorption isolator 1 and includes: a ferrite 10; a junction conductor 15 disposed on the surface of the ferrite 10 and having a first port end P1, a second port end P2, and a third port end P3; a permanent magnet (not shown) which applies a DC magnetic field to the ferrite 10; and a capacitor C1 as a reactance element.

The junction conductor 15 is a thin film formed by vapor deposition or the like of a conductive metal, or a thick film formed by applying and baking a conductive paste. A sub-line branching from a main line disposed between the port ends P1 and P2 of the junction conductor 15 is extended, for example, in an upward direction substantially perpendicular to the main line, extended around from the back surface side of the ferrite 10 to the lower surface, and is extended around to the front surface side by a short distance. One end of the capacitor C1 is connected to the port end P3. In the first embodiment, the main line means a conductor (inductors L1 and L2) between the port ends P1 and P2, and the sub-line means a conductor (inductor L3) branching from a substantially central portion of the main line and leading to the port end P3.

The ferrite absorption isolator 1 includes an input terminal electrode 31, an output terminal electrode 32, and a ground terminal electrode 33. A filter including an inductor L4 and a capacitor C2 is connected between one end (the port end P1) of the main line and the input terminal electrode 31, and a filter including an inductor L5 and a capacitor C3 is connected between the other end (the port end P2) of the main line and the output terminal electrode 32.

In the ferrite absorption isolator 1 having the above configuration, a reflected wave from the sub-line, to which the capacitor C1 is connected, is adjusted such that the phase thereof is shifted from the phase of an incident wave from the port end P1 or the port end P2 by 90 degrees at an intersection point of the junction conductor 15. Specifically, the incident wave from the port end P1 does not cause magnetic loss since a negative circular polarized wave is generated at the intersection point by the reflected wave from the sub-line, so that the incident wave is transmitted to the port end P2. Meanwhile, the incident wave from the port end P2 is absorbed due to magnetic loss of the ferrite 10 since a positive circular polarized wave is generated at the intersection point by the reflected wave from the sub-line.

Here, the material of the ferrite 10 is YIG (Y3Fe5O12) in which a part of Y is substituted with at least one element of Ho, Dy, and Gd or a part of Fe is substituted with Co. The present inventors produced YIG ferrites in which 0.02 mol, 0.05 mol, and 0.1 mol of Y are substituted with Ho, respectively, as a first material example, and measured the electric power handling characteristics and the adjacent channel leakage power characteristics of the respective YIG ferrites. In addition, for comparison, the present inventors produced a YIG ferrite in which Y is not substituted with Ho, and measured the same characteristics thereof.

Figure 2:
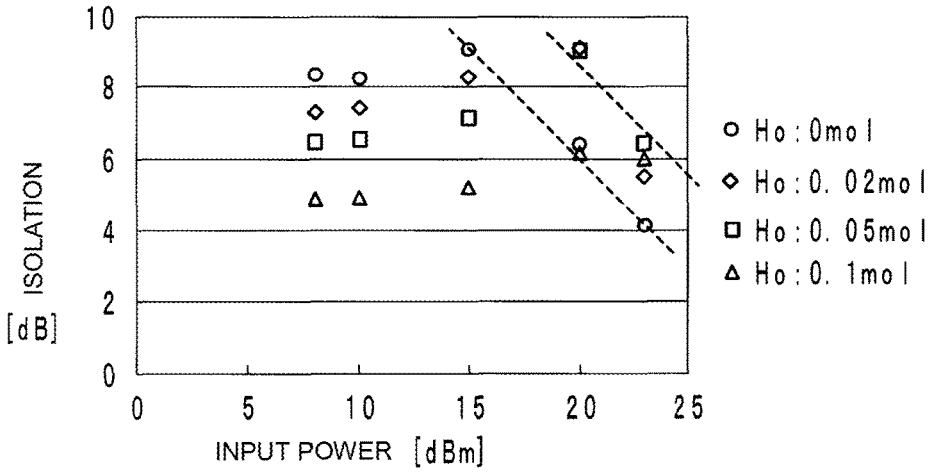
FIG. 2 is a graph showing the electric power handling characteristics of the non-reciprocal circuit element (a first material example of a ferrite) according to the first embodiment.

FIG. 2 shows a graph in which the horizontal axis represents input power and the vertical axis represents isolation characteristics. In the YIG ferrite in which Y is not substituted with Ho, when the input power is increased, the isolation characteristics greatly deteriorate from 15 dBm. Meanwhile, in the YIG ferrites in which 0.02 mol, 0.05 mol, and 0.1 mol of Y are substituted with Ho, respectively, the characteristics do not deteriorate until 20 dBm. That is, by substituting a part of Y with Ho, the YIG ferrite is configured to withstand higher input power without the deterioration of the isolation characteristics.

Figure 3:
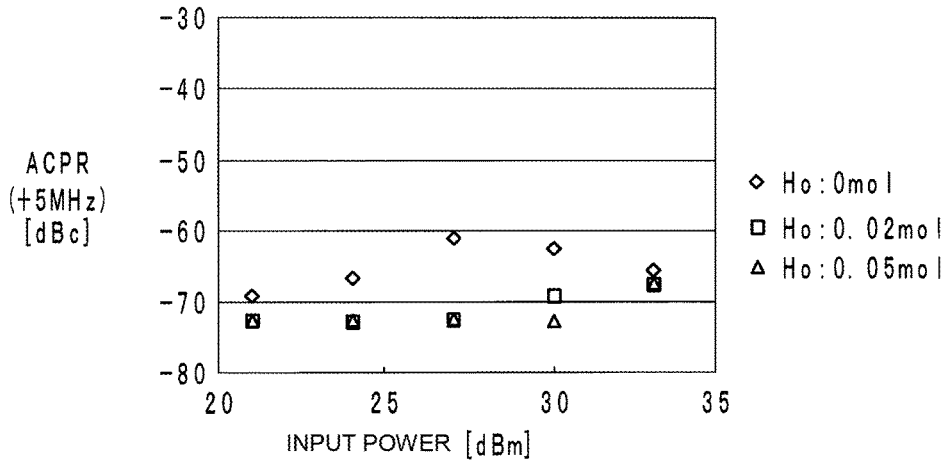
FIG. 3 is a graph showing the adjacent channel leakage power characteristics of the non-reciprocal circuit element (the first material example of the ferrite) according to the first embodiment.

FIG. 3 shows a graph in which the horizontal axis represents input power and the vertical axis represents the ACPR (adjacent channel leakage power) characteristics. In the YIG ferrite in which Y is not substituted with Ho, when the input power is increased, the ACPR characteristics deteriorate as the input power increases. Meanwhile, in the respective YIG ferrites in which 0.02 mol and 0.05 mol of Y are substituted with Ho, respectively, the ACPR does not greatly deteriorate until the input power reaches 27 dBm. In particular, in the YIG ferrite in which 0.05 mol of Y is substituted with Ho, the adjacent channel leakage power does not deteriorate even when the input power is 30 dBm.

Next, YIG ferrites in which 0.02 mol, 0.05 mol, and 0.1 mol of Y are substituted with Dy, respectively were produced as a second material example, and the electric power handling characteristics and the adjacent channel leakage power characteristics of the respective YIG ferrites were measured. In addition, for comparison, a YIG ferrite in which Y is not substituted with Dy was produced, and the same characteristics thereof were measured.

Figure 4:
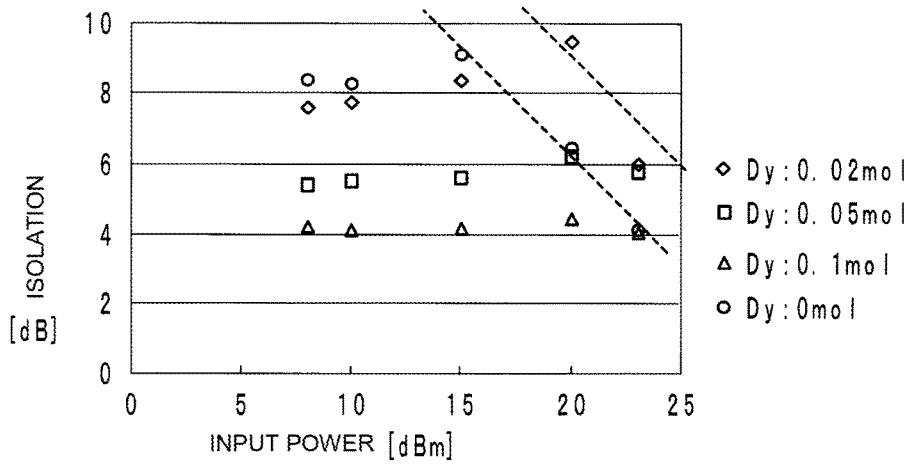
FIG. 4 is a graph showing the electric power handling characteristics of the non-reciprocal circuit element (a second material example of the ferrite) according to the first embodiment.

FIG. 4 shows electric power handling characteristics in which the horizontal axis represents input power and the vertical axis represents isolation characteristics. In the YIG ferrite in which Y is not substituted with Dy, when the input power in increased, the isolation characteristics greatly deteriorate from 15 dBm. Meanwhile, in the respective YIG ferrites in which 0.02 mol, 0.05 mol, and 0.1 mol of Y are substituted with Dy, respectively, the isolation characteristics do not deteriorate until 20 dBm. That is, by substituting a part of Y with Dy, the YIG ferrite is configured to withstand higher input power without deterioration of the isolation characteristics.

Figure 5:
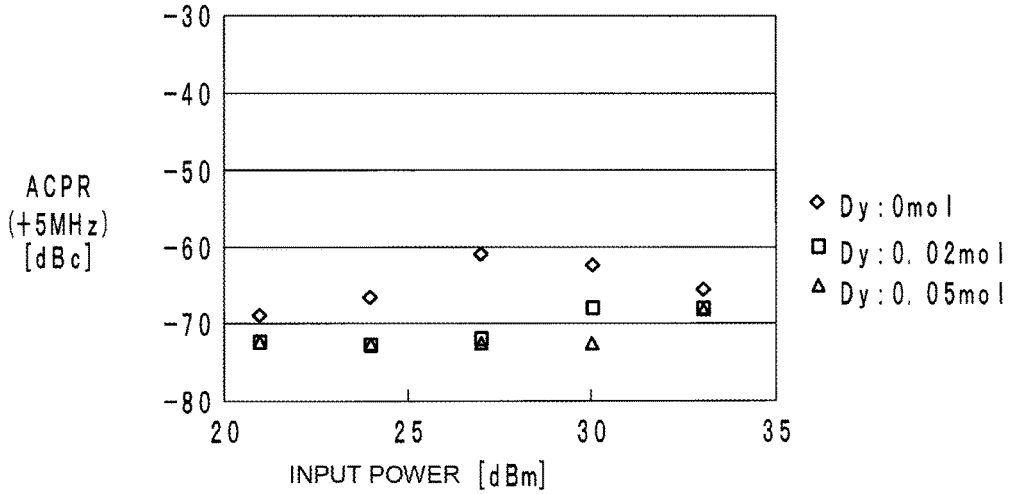
FIG. 5 is a graph showing the adjacent channel leakage power characteristics of the non-reciprocal circuit element (the second material example of the ferrite) according to the first embodiment.

FIG. 5 shows characteristics in which the horizontal axis represents input power and the vertical axis represents ACPR (adjacent channel leakage power). In the YIG ferrite in which Y is not substituted with Dy, when the input power is increased, the ACPR characteristics deteriorate as the input power increases. Meanwhile, in the respective YIG ferrites in which 0.02 mol and 0.05 mol of Y, respectively, are substituted with Dy, the ACPR does not greatly deteriorate until the input power reaches 27 dBm. In particular, in the YIG ferrite in which 0.05 mol of Y is substituted with Dy, respectively, the adjacent channel leakage power does not deteriorate even when the input power is 30 dBm.

(Second Embodiment, See FIGS. 6 to 11)

Figure 6:
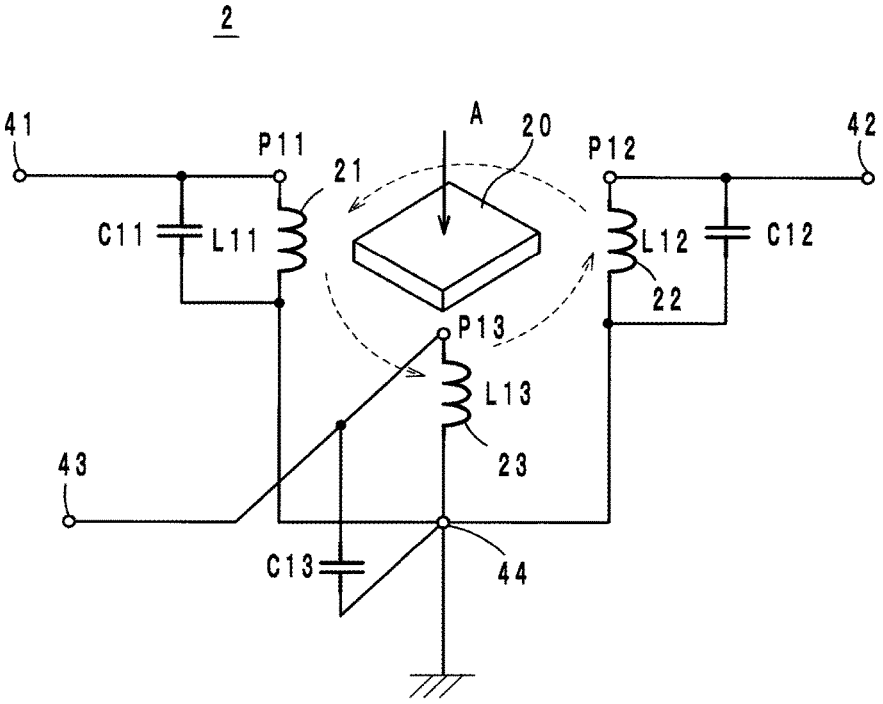
FIG. 6 is an equivalent circuit diagram of a non-reciprocal circuit element (circulator) according to a second embodiment.

As shown in FIG. 6, a non-reciprocal circuit element according to a second embodiment is a three-port-type circulator 2 in which a first center conductor 21 (inductor L11), a second center conductor 22 (inductor L12), and a third center conductor 23 (inductor L13) are disposed on a ferrite 20, to which a DC magnetic field is applied in the direction of an arrow A by a permanent magnet (not shown), so as to intersect each other at a predetermined angle in an insulated state. One end of the first center conductor 21 is a first port P11 (connected to an input/output terminal electrode 41, one end of the second center conductor 22 is a second port P12 (connected to an input/output terminal electrode 42), and one end of the third center conductor 22 is a third port P13 (connected to an input/output terminal electrode 43). The other ends of the respective center conductors 21, 22, and 23 are connected to ground via a ground terminal electrode 44. Furthermore, capacitors C11, C12, and C13 are connected in parallel with the center conductors 21, 22, and 23, respectively.

In the circulator 2 having the above configuration, a high-frequency signal inputted from the second port P12 (terminal electrode 42) is outputted from the first port 11 (terminal electrode 41). A high-frequency signal inputted from the first port 11 (terminal electrode 41) is outputted from the third port P13 (terminal electrode 43). A high-frequency signal inputted from the third port P13 (terminal electrode 43) is outputted from the second port P12 (terminal electrode 42).

In the second embodiment as well, as the ferrite 20, a YIG ferrite in which a part of Y is substituted with at least any one element of Ho, Dy, and Gd or a part of Fe is substitute with Co, may be used. The present inventors produced YIG ferrites in which 0.005 mol and 0.1 mol of Fe are substituted with Co and 0.6 mol of Y is substituted with Gd, respectively, as a third material example, and measured the electric power handling characteristics and the adjacent channel leakage power characteristics of the respective YIG ferrites. In addition, for comparison, the present inventors produced a YIG ferrite that is not substituted with any of these elements, and measured the same characteristics thereof. At the measurement, each of the ports P11, P12, and P13 is matched at 50 Ω.

Figure 7:
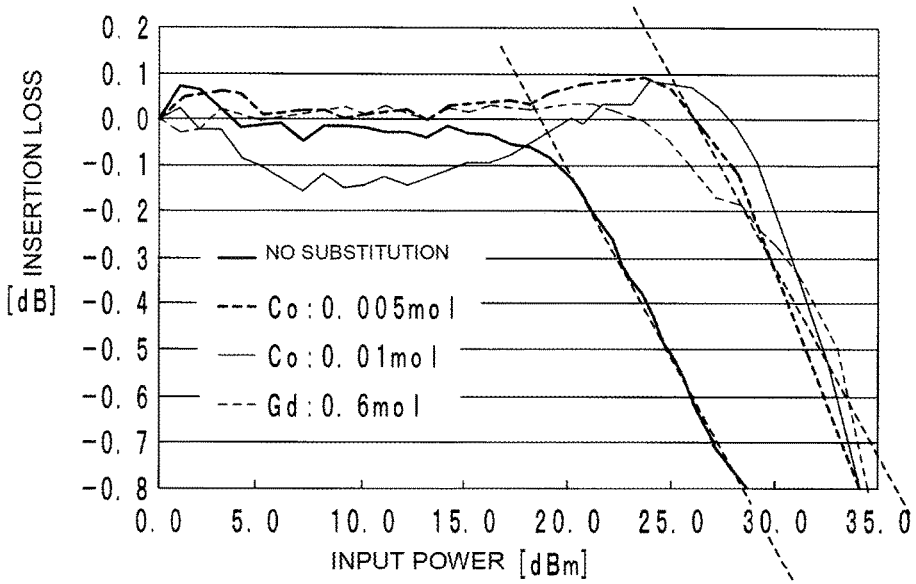
FIG. 7 is a graph showing the electric power handling characteristics of the non-reciprocal circuit element (a third material example of a ferrite) according to the second embodiment.

FIG. 7 shows electric power handling characteristics in which the horizontal axis represents input power and the vertical axis represents insertion loss. In the YIG ferrite that is not substituted, when the input power is increased, the insertion loss greatly deteriorates from 20 dBm. Meanwhile, in the respective YIG ferrites in which 0.005 mol and 0.01 mol of Fe are substituted with Co and 0.6 mol of Y is substituted with Gd, the characteristics do not deteriorate until about 25 dBm. That is, by substituting a part of Fe with Co and substituting a part of Y with Gd, the YIG ferrite is configured to withstand high input power.

Figure 8:
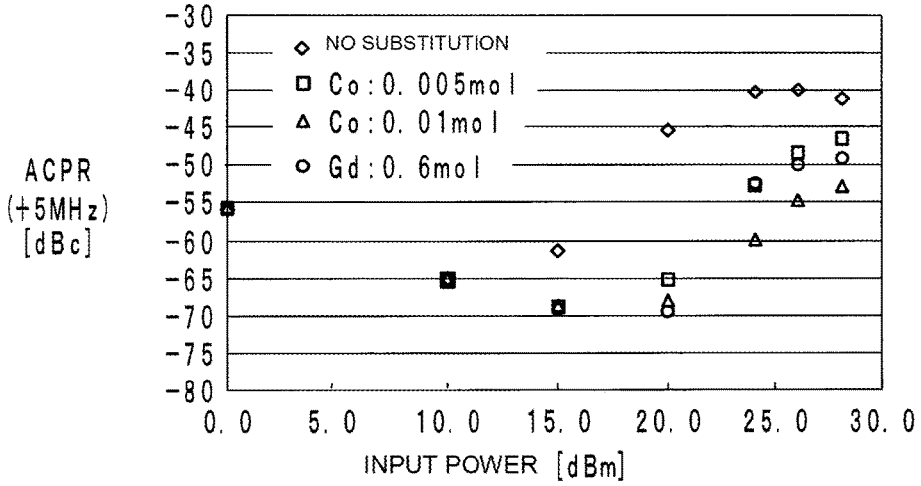
FIG. 8 is a graph showing the adjacent channel leakage power characteristics of the non-reciprocal circuit element (the third material example of the ferrite) according to the second embodiment.

FIG. 8 shows characteristics in which the horizontal axis represents input power and the vertical axis represents ACPR (adjacent channel leakage power). In the YIG that is not substituted, the adjacent channel leakage power increases from input power of 15 dBm. Meanwhile, in the respective YIG ferrites in which 0.005 mol and 0.01 mol are substituted with Co and 0.6 mol is substituted with Gd, respectively, an increase in the adjacent channel leakage power is suppressed even when the input power is 25 dBm.

Next, the present inventors produced YIG ferrites in which 0.0025 mol, 0.0050 mol, 0.0100 mol, 0.0200 mol, and 0.0500 mol of Fe are substituted with Co, respectively, as a fourth material example, incorporated each YIG ferrite into the circulator 2 according to the second embodiment, and measured the insertion loss amount of a transmission signal having a predetermined frequency inputted from the third port (terminal electrode 43) and inputted to the second port P12 (terminal electrode 42) and the amount of reduction of noise occurring in the frequency band of a reception signal corresponding to the frequency band of the transmission signal. For comparison, the present inventors produced a YIG ferrite in which Fe is not substituted with Co, and measured the same characteristics thereof.

Figure 9:
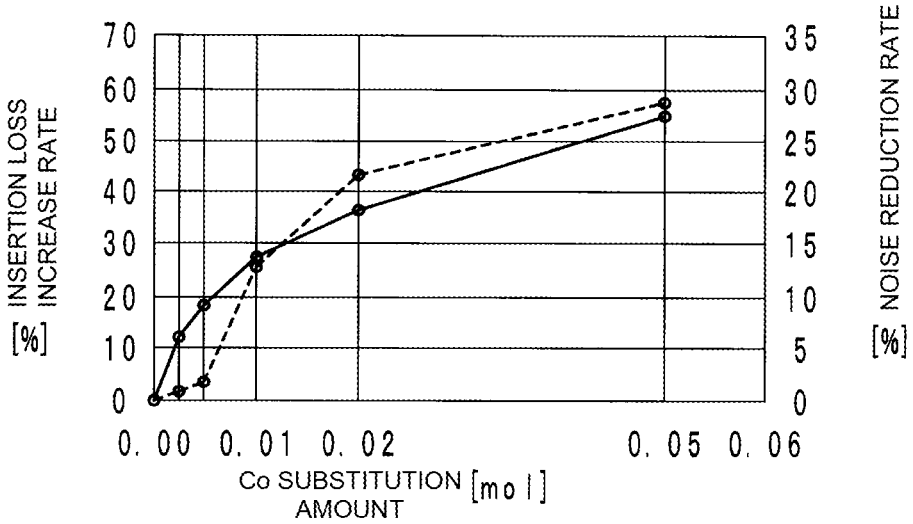
FIG. 9 is a graph showing the insertion loss increase ratio and the noise reduction ratio of the non-reciprocal circuit element (a fourth material example of the ferrite) according to the second embodiment.

FIG. 9 shows characteristics in which the horizontal axis represents a Co substitution amount, the left side of the vertical axis represents an insertion loss increase ratio, and the right side of the vertical axis represents a noise reduction ratio. The insertion loss increase ratio is indicated by a broken line, and the noise reduction ratio is indicated by a solid line. Regarding the increase ratio and the reduction ratio, the insertion loss level and the noise level obtained when the YIG ferrite that is not substituted with Co is used are set as references, and the increase amount and the reduction amount compared to the references are shown in percentage. As is obvious from FIG. 9, a great noise reduction ratio is obtained when the Co substitution amount is 0.01 mol to 0.05 mol. However, as the Co substitution amount increases, the insertion loss increase ratio also increases. That is, the noise reduction ratio and the insertion loss increase ratio have a trade-off relationship, and Fe of the YIG ferrite may be substituted with Co in a range of not lower than 0.0025 mol and not higher than 0.0200 mol, as a range where a suitable noise reduction ratio is obtained without greatly increasing the insertion loss increase ratio.

Specific values of the Co substitution amount and the insertion loss increase ratio and the noise reduction ratio associated therewith are shown in Table 1 below.

TABLE 1

| Co substitution amount [mol] | Insertion loss increase ratio [%] | Noise reduction ratio [%] |
|---|---|---|
| 0.0000 | 0.0 | 0.0 |
| 0.0025 | 1.8 | 6.1 |
| 0.0050 | 3.5 | 9.1 |
| 0.0100 | 25.7 | 13.5 |
| 0.0200 | 43.4 | 18.2 |
| 0.0500 | 57.5 | 27.4 |

In addition, the present inventors produced YIG ferrites in which 0.1 mol, 0.2 mol, 0.4 mol, and 0.6 mol of Y are substituted with Dy, as a fifth material example, incorporated each YIG ferrite into the circulator 2 according to the second embodiment, and measured the insertion loss amount of a transmission signal having a predetermined frequency inputted from the third port (terminal electrode 43) and inputted to the second port P12 (terminal electrode 42) and the amount of reduction of noise of a reception signal corresponding to the frequency band of the transmission signal. For comparison, the present inventors produced a YIG ferrite in which Y is not substituted with Dy, and measured the same characteristics thereof.

Figure 10:
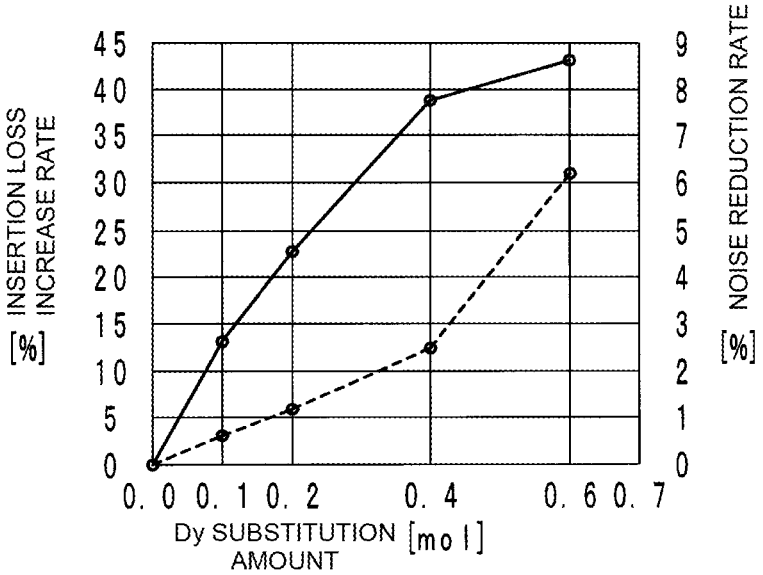
FIG. 10 is a graph showing the insertion loss increase ratio and the noise reduction ratio of the non-reciprocal circuit element (a fifth material example of the ferrite) according to the second embodiment.

FIG. 10 shows characteristics in which the horizontal axis represents a Dy substitution amount, the left side of the vertical axis represents an insertion loss increase ratio, and the right side of the vertical axis represents a noise reduction ratio. The insertion loss increase ratio is indicated by a broken line, and the noise reduction ratio is indicated by a solid line. Regarding the increase ratio and the reduction ratio, the insertion loss level and the noise level obtained when the YIG ferrite that is not substituted with Dy is used are set as references, and the increase amount and the reduction amount compared to the references are shown in percentage. As is obvious from FIG. 10, a great noise reduction ratio is obtained when the Dy substitution amount is 0.2 mol to 0.6 mol. However, as the Dy substitution amount increases, the insertion loss increase ratio also increases. That is, the noise reduction ratio and the insertion loss increase ratio have a trade-off relationship, and Y of the YIG ferrite may be substituted with Dy in a range of not lower than 0.1 mol and not higher than 0.4 mol, as a range where a suitable noise reduction ratio is obtained without greatly increasing the insertion loss increase ratio.

Specific values of the Dy substitution amount and the insertion loss increase ratio and the noise reduction ratio associated therewith are shown in Table 2 below.

TABLE 2

| Dy substitution amount [mol] | Insertion loss increase ratio [%] | Noise reduction ratio [%] |
|---|---|---|
| 0.0 | 0.0 | 0.00 |
| 0.1 | 3.1 | 2.66 |
| 0.2 | 6.0 | 4.54 |

TABLE 2-continued

| Dy substitution amount [mol] | Insertion loss increase ratio [%] | Noise reduction ratio [%] |
|---|---|---|
| 0.4 | 12.6 | 7.77 |
| 0.6 | 31.1 | 8.62 |

Further, the present inventors produced YIG ferrites in which 0.02 mol, 0.05 mol, and 0.10 mol of Y are substituted with Ho, as a sixth material example, incorporated each YIG ferrite into the circulator 2 according to the second embodiment, and measured the insertion loss amount of a transmission signal having a predetermined frequency inputted from the third port (terminal electrode 43) and inputted to the second port P12 (terminal electrode 42) and the amount of reduction of noise of a reception signal with respect to the frequency band of the transmission signal. For comparison, the present inventors produced a YIG ferrite in which Y is not substituted with Ho, and measured the same characteristics thereof.

Figure 11:
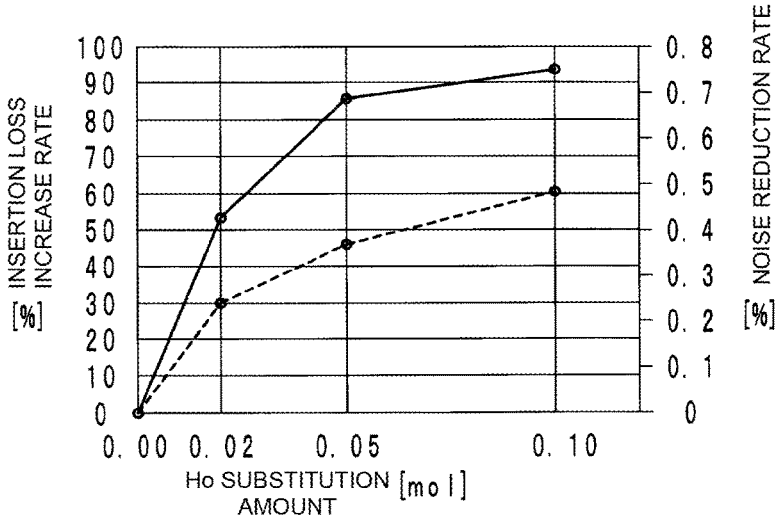
FIG. 11 is a graph showing the insertion loss increase ratio and the noise reduction ratio of the non-reciprocal circuit element (a sixth material example of the ferrite) according to the second embodiment.

FIG. 11 shows characteristics in which the horizontal axis represents a Ho substitution amount, the left side of the vertical axis represents an insertion loss increase ratio, and the right side of the vertical axis represents a noise reduction ratio. The insertion loss increase ratio is indicated by a broken line, and the noise reduction ratio is indicated by a solid line. Regarding the increase ratio and the reduction ratio, the insertion loss level and the noise level obtained when the YIG ferrite that is not substituted with Ho is used are set as references, and the increase amount and the reduction amount compared to the references are shown in percentage. As is obvious from FIG. 11, a great noise reduction ratio is obtained when the Ho substitution amount is 0.02 mol to 0.10 mol. However, as the Ho substitution amount increases, the insertion loss increase ratio also increases. That is, the noise reduction ratio and the insertion loss increase ratio have a trade-off relationship, and Y of the YIG ferrite may be substituted with Ho in a range of not lower than 0.02 mol and not higher than 0.05 mol, as a range where a suitable noise reduction ratio is obtained without greatly increasing the insertion loss increase ratio.

Specific values of the Ho substitution amount and the insertion loss increase ratio and the noise reduction ratio associated therewith are shown in Table 3 below.

TABLE 3

| Ho substitution amount [mol] | Insertion loss increase ratio [%] | Noise reduction ratio [%] |
|---|---|---|
| 0.0 | 0.0 | 0.0 |
| 0.02 | 30.1 | 0.43 |
| 0.05 | 46.1 | 0.69 |
| 0.10 | 60.7 | 0.75 |

Figure 12:
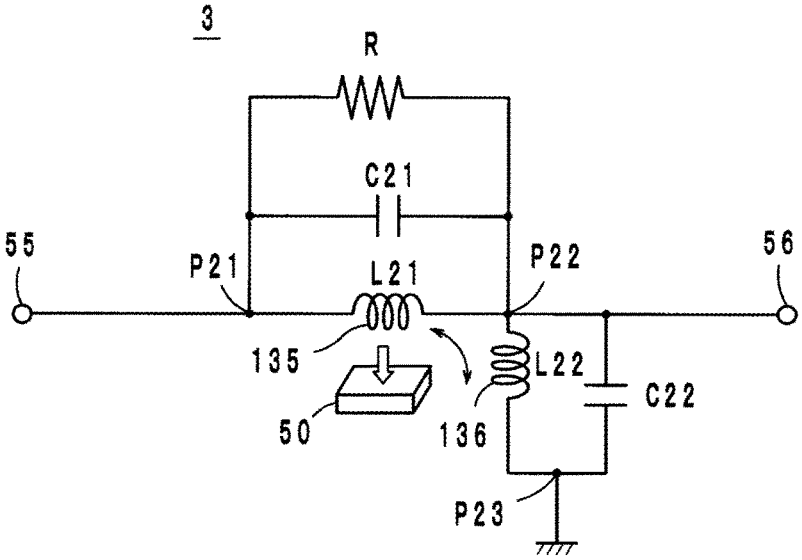
FIG. 12 is an equivalent circuit diagram showing a non-reciprocal circuit element (isolator) according to a third embodiment.

(Third Embodiment, See FIG. 12)

As shown in FIG. 12, a non-reciprocal circuit element according to a third embodiment is a two-port-type isolator 3 in which a first center conductor 135 (inductor L21) and a second center conductor 136 (inductor L22) are disposed on a ferrite 50, to which a DC magnetic field A is applied, so as to intersect each other in an insulated state. One end of the first center conductor 135 is an input port P21, the other end of the first center conductor 135 and one end of the second center conductor 136 are an output port P22, and the other end of the second center electrode 136 is a ground port P23. Furthermore, a matching capacitor C21 and a resistance element R are connected in parallel between the input port P21 and the output port P22, and a capacitor C22 is connected in parallel with the second center conductor 136. The first port P21 is connected to an input terminal electrode 55, and the second port P22 is connected to an output terminal electrode 56.

In the isolator 3 having the above configuration, when a high-frequency signal is inputted from the first port P21 (input terminal electrode 55), a large high-frequency current flows through the second center conductor 136, almost no high-frequency current flows through the first center conductor 135, and the high-frequency signal is outputted from the second port P22 (output terminal electrode 55). Meanwhile, when a high-frequency signal is inputted from the second port P22, the high-frequency signal is attenuated by a parallel resonant circuit formed by the first center conductor 135 and the capacitor C21, and is absorbed and attenuated by the resistance element R.

In the third embodiment as well, as the ferrite 50, a YIG ferrite in which a part of Y is substituted with at least any one element of Ho, Dy, and Gd or a part of Fe is substituted with Co, may be used. In the isolator 3 using the YIG ferrite substituted with these elements, as compared to an isolator 3 using a YIG ferrite that is not substituted, the electric power handling characteristics improve and the adjacent channel leakage power reduces. In addition, as shown in the fourth material example, the fifth material example, and the sixth material example, it is possible to reduce noise between adjacent ports and suppress an increase in insertion loss as much as possible.

The non-reciprocal circuit element according to the present disclosure is not limited to the embodiments described above, and can be modified in a variety of ways within the scope of the present disclosure.

For example, the extended shapes of the junction conductors and the center conductors are optional, and the input/output direction may be reversed by changing the phase of magnetic coupling between the center conductors in accordance with the direction in which the DC magnetic field is applied.

As described above, the present disclosure is useful for non-reciprocal circuit elements (an isolator, a circulator), and is excellent in that the electric power resistance improves and the leakage power between adjacent channels reduces, and in that it is possible to reduce noise between adjacent ports and suppress an increase in insertion loss as much as possible.

1, 2, 3 non-reciprocal circuit element
10, 20, 50 ferrite
15 junction conductor
21, 22, 23, 135, 136 center conductor
P1, P2, P3 port
P11, P12, P13, P21, P22 port

The invention claimed is:

1. A non-reciprocal circuit element comprising:
a YIG ferrite represented by a formula of $Y_3Fe_5O_{12}$; and
a plurality of conductors disposed on the YIG ferrite and intersecting each other in an insulated state, wherein
a part of Y of the YIG ferrite is substituted with at least any one element of Ho, Dy, and Gd or a part of Fe of the YIG ferrite is substituted with Co.

2. The non-reciprocal circuit element according to claim 1, wherein the plurality of conductors comprise a first center conductor, a second center conductor and a third center conductor disposed on the YIG ferrite so as to intersect each other in an insulated state.

3. The non-reciprocal circuit element according to claim 1, wherein the plurality of conductors comprise a junction conductor having a first port, a second port, and a third port and disposed on the YIG ferrite, and
the junction conductor includes a main line disposed between the first port and the second port and a sub-line branching from the main line and leading to the third port.

4. The non-reciprocal circuit element according to claim 1, wherein
a DC magnetic field is applied to the YIG ferrite, and
a phase speed of a magnetic coupling between the plurality of conductors is changed on a basis of a direction in which the DC magnetic field is applied.

5. The non-reciprocal circuit element according to claim 4, wherein the plurality of conductors comprise a first center conductor, a second center conductor and a third center conductor disposed on the YIG ferrite so as to intersect each other in an insulated state.

6. The non-reciprocal circuit element according to claim 1, wherein
the part of Y of the YIG ferrite is substituted with Ho, and a substitution amount of Y is 0.02 mol to 0.05 mol.

7. The non-reciprocal circuit element according to claim 6, wherein
a DC magnetic field is applied to the YIG ferrite, and
a phase speed of a magnetic coupling between the plurality of conductors is changed on a basis of a direction in which the DC magnetic field is applied.

8. The non-reciprocal circuit element according to claim 6, wherein the plurality of conductors comprise a first center conductor, a second center conductor and a third center conductor disposed on the YIG ferrite so as to intersect each other in an insulated state.

9. The non-reciprocal circuit element according to claim 1, wherein a total of a substitution amount of any element of Ho, Dy, and Gd, or Co is equal to or less than 1 mol.

10. The non-reciprocal circuit element according to claim 9, wherein
a DC magnetic field is applied to the YIG ferrite, and
a phase speed of a magnetic coupling between the plurality of conductors is changed on a basis of a direction in which the DC magnetic field is applied.

11. The non-reciprocal circuit element according to claim 9, wherein the plurality of conductors comprise a first center conductor, a second center conductor and a third center conductor disposed on the YIG ferrite so as to intersect each other in an insulated state.

12. The non-reciprocal circuit element according to claim 9, wherein the plurality of conductors comprise a junction conductor having a first port, a second port, and a third port and disposed on the YIG ferrite, and
the junction conductor includes a main line disposed between the first port and the second port and a sub-line branching from the main line and leading to the third port.

13. The non-reciprocal circuit element according to claim 1, wherein
the part of Fe of the YIG ferrite is substituted with Co, and a substitution amount of Fe is 0.0025 mol to 0.0200 mol.

14. The non-reciprocal circuit element according to claim 13, wherein
a DC magnetic field is applied to the YIG ferrite, and
a phase speed of a magnetic coupling between the plurality of conductors is changed on a basis of a direction in which the DC magnetic field is applied.

15. The non-reciprocal circuit element according to claim 13, wherein the plurality of conductors comprise a first center conductor, a second center conductor and a third center conductor disposed on the YIG ferrite so as to intersect each other in an insulated state.

16. The non-reciprocal circuit element according to claim 13, wherein the plurality of conductors comprise a junction conductor having a first port, a second port, and a third port and disposed on the YIG ferrite, and the junction conductor includes a main line disposed between the first port and the second port and a sub-line branching from the main line and leading to the third port.

17. The non-reciprocal circuit element according to claim 1, wherein the part of Y of the YIG ferrite is substituted with Dy, and a substitution amount of Y is 0.1 mol to 0.4 mol.

18. The non-reciprocal circuit element according to claim 17, wherein a DC magnetic field is applied to the YIG ferrite, and a phase speed of a magnetic coupling between the plurality of conductors is changed on a basis of a direction in which the DC magnetic field is applied.

19. The non-reciprocal circuit element according to claim 17, wherein the plurality of conductors comprise a first center conductor, a second center conductor and a third center conductor disposed on the YIG ferrite so as to intersect each other in an insulated state.

20. The non-reciprocal circuit element according to claim 17, wherein the plurality of conductors comprise a junction conductor having a first port, a second port, and a third port and disposed on the YIG ferrite, and the junction conductor includes a main line disposed between the first port and the second port and a sub-line branching from the main line and leading to the third port.

* * * * *